United States Patent [19]

Heimberger

[11] 4,067,208

[45] Jan. 10, 1978

[54] WARP-KNIT SLIDE-FASTENER SUPPORT TAPE AND METHOD OF MAKING SAME

[75] Inventor: Helmut Heimberger, Locarno, Switzerland

[73] Assignee: Optilon W. Erich Heilmann GmbH, Cham, Switzerland

[21] Appl. No.: 728,031

[22] Filed: Sept. 30, 1976

[30] Foreign Application Priority Data

June 15, 1976 Germany ..... 2626663

[51] Int. Cl.[2] ..... D04B 23/08; D04B 21/00

[52] U.S. Cl. ..... 66/193; 66/195; 24/205.16 C

[58] Field of Search ..... 66/190–195; 24/205.1 C, 205.16

[56] References Cited

U.S. PATENT DOCUMENTS

| | | | |
|---|---|---|---|
| 3,864,946 | 2/1975 | Matsuda | 66/193 |
| 3,874,036 | 4/1975 | Yoshikawa | 24/205.1 C |
| 3,922,760 | 12/1975 | Matsuda | 24/205.16 R |
| 3,926,017 | 12/1975 | Matsuda | 66/195 |
| 3,974,549 | 8/1976 | Matsuda | 24/205.1 C |

FOREIGN PATENT DOCUMENTS

| | | | |
|---|---|---|---|
| 2,200,444 | 7/1973 | Germany | 24/205.16 C |

*Primary Examiner*—Ronald Feldbaum
*Attorney, Agent, or Firm*—Karl F. Ross

[57] ABSTRACT

A slide-fastener support tape is made in a warp-knitting machine which chains a plurality of relatively thin warp yarns to form an array of longitudinally extending and transversely spaced wales. One of the needles of the knitting machine is left empty so as to space the edge-most warp yarn from the other warp yarns by a gap corresponding to the transverse width of one wale. A relatively thick warp yarn is blind-lapped into this gap. A group of first weft yarns is laid into the warp yarns to one side of the thick yarn and a group of second weft yarns is lapped into the warp yarns with loop formations to the other side of the thick yarn. It is also possible to provide a second such thick yarn in the tape, held in place by a group of third weft yarns which are also lapped into the tape.

24 Claims, 7 Drawing Figures

FIG. 3A
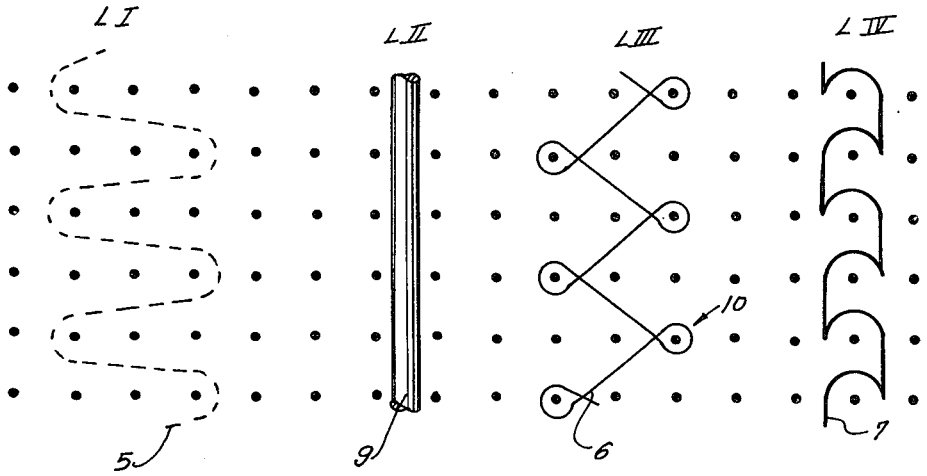
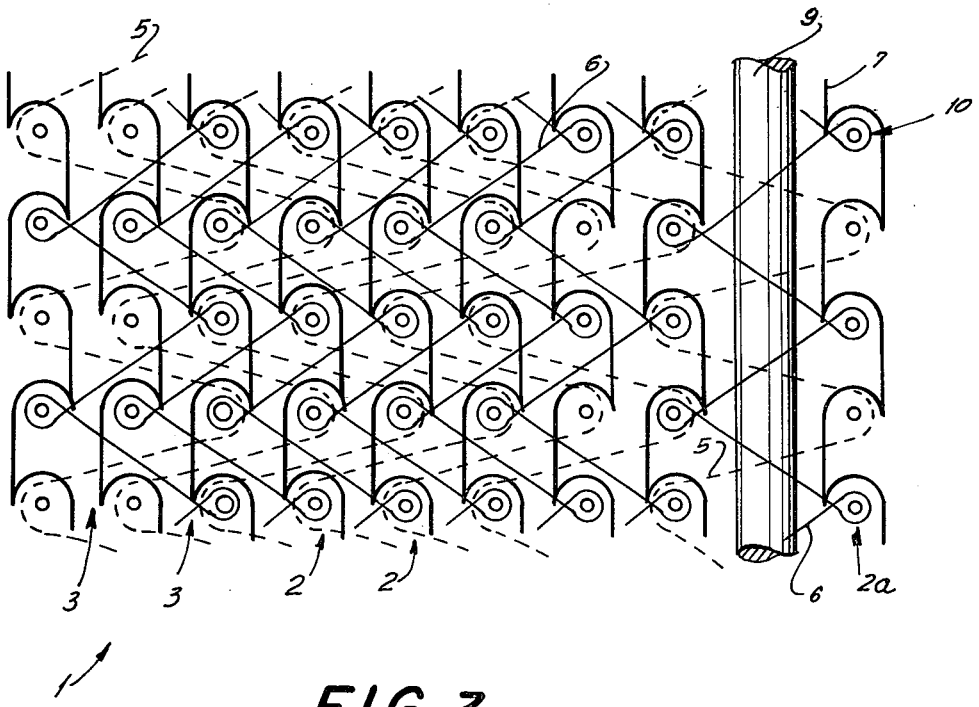
FIG. 3

FIG. 5A
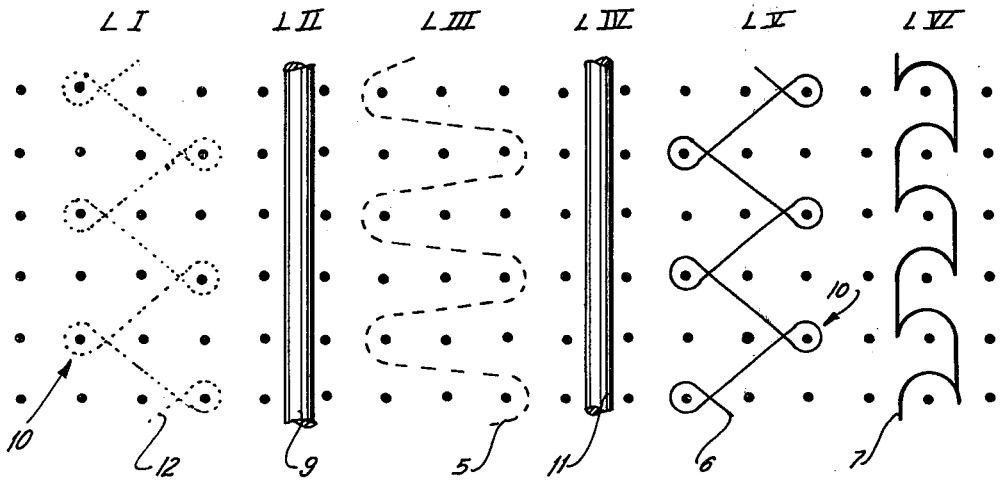
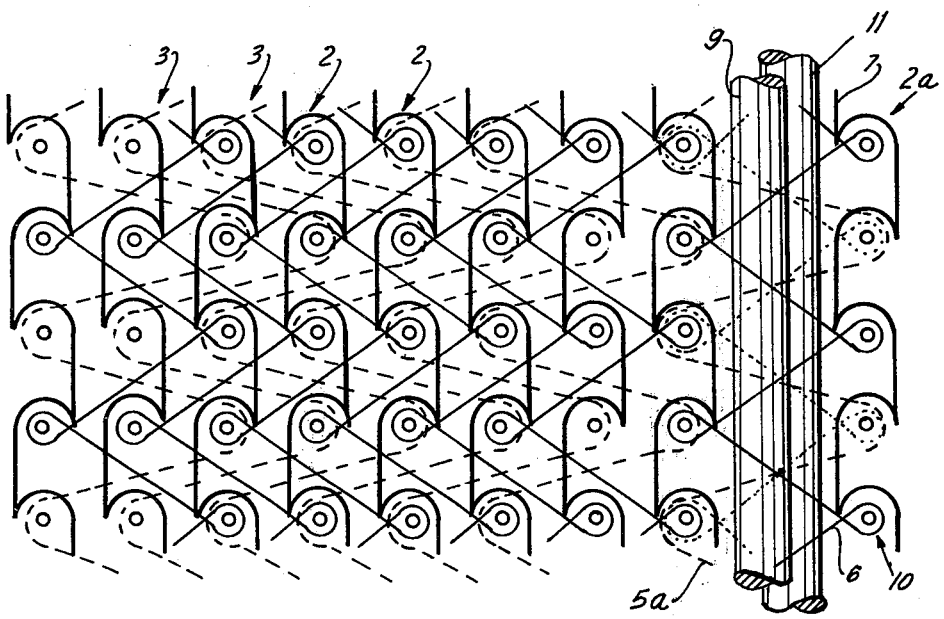
FIG. 5

WARP-KNIT SLIDE-FASTENER SUPPORT TAPE AND METHOD OF MAKING SAME

CROSS-REFERENCE TO RELATED APPLICATIONS

This application is related to my concurrently filed commonly assigned and copending patent applications Ser. No. 728,136; Ser. No. 728,031; Ser. No. 728,134; Ser. No. 728,033; Ser. No. 728,135; Ser. No. 728,034; Ser. No. 728,133; Ser. No. 728,035; and Ser. No. 728,132.

FIELD OF THE INVENTION

The present invention relates to a knit slide-fastener support tape and stringer using same. More particularly this invention concerns such a tape adapted to carry a coupling element formed by a succession of discrete coupling heads or teeth.

BACKGROUND OF THE INVENTION

It is known to produce a warp-knit support tape to which is stitched a helicoidal monofilamentary coupling element. The slide-fastener stringer half constituted by the coupling element, tape, and stitching securing the two together is ideally suited for use in a light-duty or medium-duty slide fastener.

For heavy-duty slide fasteners a helicoidal monofilamentary coupling element is not generally used. Instead a succession of discrete teeth of metal or of synthetic-resin material are secured to the edge of the support tape. To this end the support-tape edge must be thickened so that the teeth can be mounted astraddle the edge. In most arrangements this is done simply by loading the edgemost needle of the warp-knitting machine with a warp end of the largest possible gauge that the needle can accommodate.

Practice has shown, however, that such a warp-knit tape is often insufficiently strong at its edge to withstand the considerable transverse forces that are applied to it. In addition such a tape frequently has at least limited longitudinal stretchability at the edge which the teeth straddle, so that the intertooth spacing can change as the tape is deformed, which renders the slide fastener almost worthless in uses where longitudinal stress is present.

OBJECTS OF THE INVENTION

It is therefore an object of the present invention to provide an improved slide-fastener support tape and method of making same.

Another object is the provision of such a support tape with a thickened edge that is suitable for carrying heavy-duty slide-fastener coupling teeth or heads.

Yet another object is the provision of such a tape which can be knit with a conventional knitting machine, yet which has extremely good longitudinal dimensional stability at the edge for mounting the element, and which is sufficiently thick that the coupling heads or teeth can gain a good purchase on the tape.

Still another object of the invention is to provide an improved slide-fastener stringer half of a heavy-duty type.

SUMMARY OF THE INVENTION

These objects are attained according to the present invention in a slide-fastener support tape comprising a plurality of relatively thin warp yarns forming an array of longitudinally extending and transversely spaced wales, a group of first weft yarns crossing the warp yarns and each extending transversely over a plurality of wales, a group of second weft yarns lapped into and forming loops in the warp yarns and each extending over a plurality of the wales, and a relatively thick warp yarn which extends parallel to the wales between the wale at the edge of the array and the adjacent wale, and between the first weft yarns on one side and the second weft yarns on the other side. Such a support tape is made by blind-lapping the thick warp yarn in place of an omitted warp yarn, so that the one needle of the knitting machine is left empty and in its place a relatively thick warp yarn is blind-lapped along the full length of the tape.

Such a support tape is ideally suited for the straddle-mounting of discrete coupling teeth. The thick warp, which may be much thicker than would normally be permissible since it is not passed through a needle of the knitting machine, is held securely in place. In the plane of the tape the thick warp yarn is flanked by two chains of relatively thin warp yarns, to one side of the plane there are the first weft yarns and to the other side of this plane there are the other weft yarns so that the relatively thick warp yarn can extend straight through the tape, but is bound in on all sides. Since at least the second group of weft yarns is lapped into the fabric so as to form loops in the warp yarn slippage of this relatively thick warp yarn is almost entirely ruled out.

According to a further feature of this invention the first weft yarns are laid into the warp yarns, without formation of loops. Thus a tape which is also transversely dimensionally stable is produced. These first weft yarns are laid in over three wales or needles each. Similarly the second weft yarns are lapped in over three wales or needles. The warp yarns are simple chains extending over one wale.

According to still another feature of this invention a second such relatively thick warp yarn is similarly laid into the gap between the edgemost wale and the adjacent wale, that is in place of the dropped thin warp yarn. A group of third weft yarns is lapped into the thin warp yarns and this second thick warp yarn is thus held between the first inlaid weft yarns and the third lapped weft yarns. Such an assembly is extremely useful for very heavy-duty slide-fasteners because a very thick welt is produced at the edge of the tape and the tape has very good longitudinal dimensional stability.

In accordance with yet another feature of this invention the yarns at the thickened edge of the tape are all of cotton, whereas the rest of the tape is polyester. Thus the tape can be heat-treated so as to shrink the various yarns around this edge and ensure that the warp yarn is tightly bound in place. The filaments surrounding the thick warp yarn are tensioned so tightly or shrunk to such an extent that they are embedded or recessed in this warp yarn. It is thus possible to use a thick cotton warp yarn and thereafter to mold the coupling elements (by injection molding in the case of synthetic-resins) directly onto the thickened edge of the tape without damage to the filaments holding the thick warp yarn in place.

The tape according to this invention can be produced with such a very thick edge that it is possible to use it with very large heavy-duty coupling teeth. Furthermore the thickness is imparted to the edge by means of a yarn which can be knit into the tape with no difficulty by conventional knitting machines. This thickened yarn is, furthermore, so well integrated with the tape that it can withstand extremely great transverse stresses without tearing free.

The term "blind lapped" as used herein to refer to the warp-extending cord or welt or bead cord, is intended to describe, in the usual sense, an inlaying without looping at the needles or warp-chain loops, the blind lapped yarn being merely held in place by the weft which bridges the warp chains.

The warp chains or pillars, which define valleys extending in the warp or longitudinal direction between them, can be of the type described in U.S. Pat. No. 3,708,830, i.e. of the single-bar or single-needle type bridged only by the weft. A warp gap is provided adjacent this edge warp chain corresponding in location to the location which would have been occupied by the wrp chain adjacent the edge warp chain or wale if the warp chains were uniformly spaced across the tape, and the bead-forming yarn or thread lying along the warp gap as a so-called "stationary" thread and held in place by the ground knit and especially the weft which is locked into the warp chains on both sides of the bead-forming yarn. The latter can be considerbly thicker than the other threads of the ground knit.

The weft preferably includes at least one bead-binding thread or yarn which extends from side to side across the bead-forming yarn and is, to either side of the latter, looped into the edge warp chain and the other warp chain adjacent the warp gap.

It is indeed surprising that, in the manner described, it is possible to anchor a nonlooped or stationary thread in a knitted tape so firmly that it can serve to mount the coupling elements. The effect is even more pronounced when the binding yarn forms loops at the warp chains, i.e., is itself knitted into the ground knit as a "tricot" or "fabric" yarn. The necessary force for gripping the stationary or bead-forming thread, is as noted, generated at least in part by making the binding yarn shrinkable and shrinking it after it has been knitted over the stationary thread.

On one embodiment of the invention the binding thread can be a simple inlaid weft, while in another it is a mesh-forming thread having its own loops at locations at which it reverses direction.

In the first case the inlaid weft is laid over three needles or wale positions in a 0-0/3-3 pattern while in the second case the binding thread forms a so-called fabric pattern e.g. 2-3/1-0. The bead-forming yarn has preferably a 0-0 pattern.

While the warp chains are preferably single-needle warps of 1-0/0-1 pattern as described in the aforementioned patent, I do not mean to exclude other ground knits as described, for example, in the above-identified copending applications.

When two such bead-forming yarns are laid in 0-0 pattern in place of the omitted warp chain, the binding threads, preferably in the aforementioned fabric pattern 2-3/1-0 or 1-0/2-3 lie above and below each of the bead-forming yarns individually.

In spite of the fact that all of the yarns, except the binding threads and bead-forming threads which preferably are cotton, consist of a thermoplastic synthetic-resin (e.g. polyester staple fiber), it is possible to injection mold thermoplastic coupling members onto the bead. Moreover, since the bead is elastically yieldable it can accommodate clamped on metal coupling members which can have sharp edges.

BRIEF DESCRIPTION OF THE DRAWINGS

The above and other objects, features and advantages of the present invention will become more readily apparent from the following description, reference being made to the accompanying drawing in which:

FIG. 3 is a large-scale diagrammatic view illustrating the makeup of the tape of FIGS. 1 and 2;

FIG. 3A is a large-scale diagrammatic view illustrating the patterning of the yarns constituting the tape of FIG. 3;

FIGS. 5 and 5A are views similar to FIGS. 3 and 3A, respectively, illustrating the makeup of the tape of FIG. 4.

SPECIFIC DESCRIPTION

Figure 1:
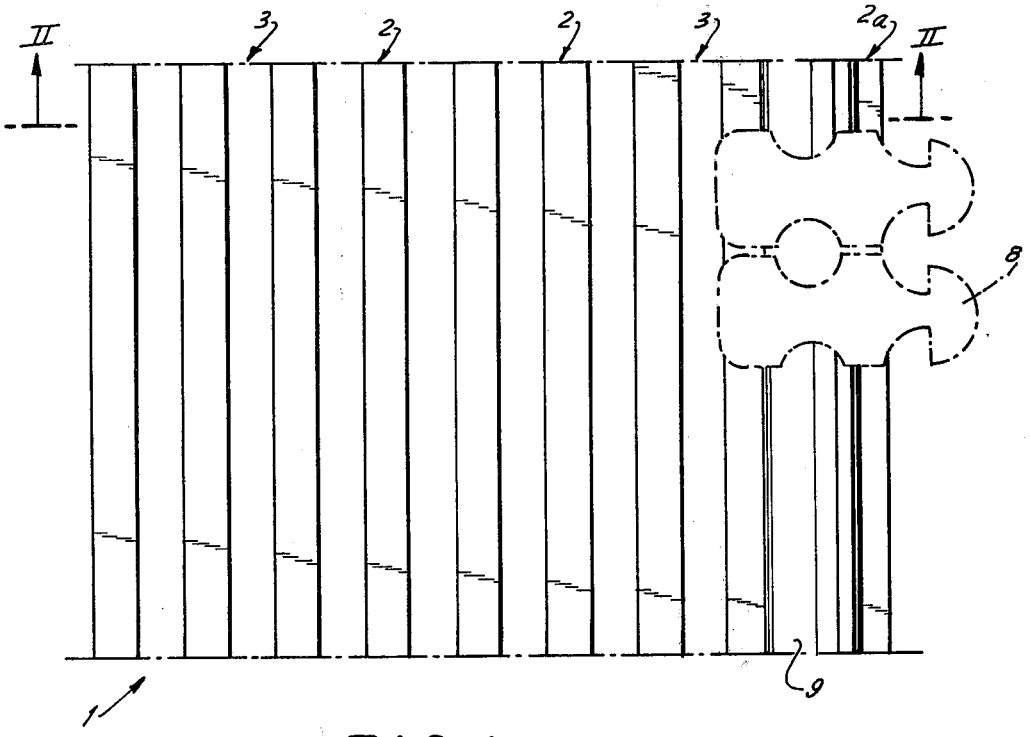
FIG. 1 is a top view of a portion of a slide-fastener stringer half according to this invention.
Figure 2:
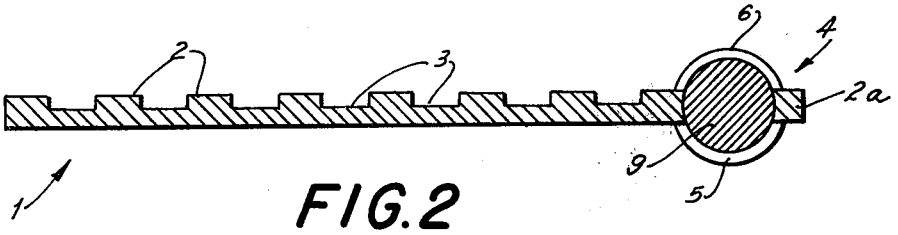
FIG. 2 is a section taken along line II — II of FIG. 1.

As shown in FIGS. 1 and 2 a slide-fastener support tape 1 has a plurality of longitudinally extending wales 2 separated by valleys 3. This tape 1 has a thickened edge 4 adapted to receive coupling teeth 8 which are mounted astraddle the thickened edge 4.

FIGS. 3 and 3A show how the tape 1 can be knit with a knitting machine having a single needle bar and four guide bars LI - LIV. The tape 1 is formed of a ground knit constituted by weft yarns 5 and 6 respectively knit by guide bars LI and LIII, and by warp yarns 7 knit with the guide bar LIV. In addition guide bar LII blind-laps a large-diameter cord 9 in a gap left between the edgemost wale **2*a* and the other wales 2. To this end the needle immediately adjacent edge wale 2*a* of the knitting machine is left empty so that a gap having the width of one wale is left for this thick warp yarn 9**.

The weft yarns 5 are each laid in over three wales 2; however, the weft yarns 6 are lapped in with formation of loops 10 also over three wales 2. Each of these wales 2 is formed by one chain constituted by a single warp yarn 7.

Thus the yarns are patterned as follows:

Weft yarn 5—0-0/3-3;
weft yarn 6—2-3/1-0;
warp yarn 7—1-0.0-1; and
warp yarn 9—0-0.

It is therefore noted that the direction of lap of the filaments 5 and 6 is opposite so that they will lie to either side of the thick warp yarn 9 and lock securely in place. The closed loops 10 formed by the lapped yarns 6 hold the edge wale **2*a* tightly against the side of the filaments 9. The yarns 6 are tensioned so tightly around the yarn 9 that they embed themselves in this yarn 9 and allow the coupling teeth 8 readily to be fitted astraddle over the thickened edge 4**.

Figure 4:
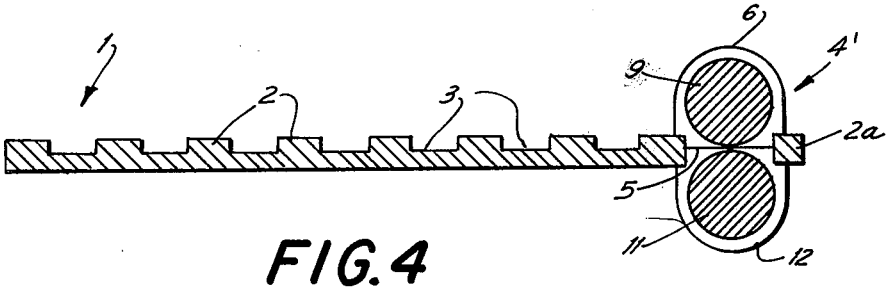
FIG. 4 is a view similar to FIG. 2 showing an alternate form of the tape according to this invention.

FIGS. 4, 5 and 5A shown another arrangement where in addition to the thick warp yarn 9 there is a second such thick warp yarn 11, and a second lapped weft yarn 12. In this arrangement the guide bars LI—LVI of the knitting machine are respectively responsible for the filaments 12, 9, 5, 11, 6 and 7. The yarns 6 and 12 are oppositely lapped to each other and the filament 11 is helt between the laid-in weft yarns 5 and the yarns 12. In addition the weft yarn **5*a* at the edge of this tape 1' of FIG. 5 is somewhat thicker in order further to increase the thickness of the edge 4' of the tape 1'**.

In this tape the patterning is as follows:
Weft yarn 12—1-0/2-3;
warp yarn 9—0-0;
weft yarn 5—0-0/3-3;
warp yarn 11—0-0;
weft yarn 6—2-3/1-0; and
warp yarn 7—1-0/0-1.

Such a knit is extremely durable and, indeed, constitutes at the edge a full tricot with a laid-in weft.

It is noted that unlike the arrangement of FIGS. 1—3 the tape of FIGS. 4, 5 and 5A has the yarns 5*a* and 12 only at the edge where the yarns 9 and 11 are. In the rest of the tape the yarns 5, 6 and 7 only are used.

According to this invention the entire tape may be heat shrunk afterward, with only the filaments at the edge being of heat-resistant fibers such as cotton. It is also possible to mold the teeth 8 directly onto the tape without damaging it.

I claim:

1. A slide-fastener support tape comprising:

a plurality of relatively thin warp yarns forming an array of longitudinally extending and transversely spaced wales defining respective warp pillars;

a group of first weft yarns crossing said warp yarns and each extending transversely over a plurality of wales;

a group of second yarns lapped into and forming loops from course to course in said warp yarns and each extending over a plurality of said wales, said yarns forming a ground knit omitting a warp pillar immediately from a wale; at an edge of the tape; and a relatively thick laid-in warp yarn extending parallel to said wales between the wale at the edge of said array and the adjacent wale at the location of the omitted warp pillar and between said first weft yarns on one side and said second yarns on the other side.

2. The tape defined in claim 1 wherein said first weft yarns are laid into said warp yarns.

3. The tape defined in claim 1, further comprising a second such relatively thick warp yarn extending parallel to said wales between said wale at said edge and said adjacent wale, and a group of third weft yarns lapped into and forming loops in said warp yarns and each extending over a plurality of said wales, said second warp yarn lying between said first weft yarns and said third weft yarns.

4. The tape defined in claim 1 wherein said first weft yarns include a relatively thick first weft yarn at said edge over said thick warp yarn and a plurality of relatively thin weft yarns.

5. The tape defined in claim 1 wherein said yarns at said edge including said thick warp yarn are of cotton and the other yarns are polyester.

6. A method of making a slide-fastener support tape comprising the steps of:

chaining a plurality of relatively thin warp yarns to form an array of longitudinally extending and transversely spaced wales;

spacing the edgemost warp yarn from the other warp yarns by a gap corresponding to the transverse width of one wale;

blind-lapping a relatively thick warp yarn in said gap;

inserting a group of first weft yarns each extending over a plurality of said wales into said warp yarns to one side of said thick yarn; and inserting a group of second yarns each extending over a plurality of said wales into said warp yarns to the other side of said thick yarn.

7. The method defined in claim 6 wherein said first weft yarns are patterned 0-0/3-3.

8. The method defined in claim 6 wherein said second yarns are patterned 2-3/1-0.

9. The method defined in claim 6 wherein said thick yarn is patterned 0-0.

10. The method defined in claim 6 wherein said thin warp yarns are patterned 1-0/0-1.

11. The method defined in claim 6, further comprising the steps of:

inserting a group of third weft yarns each extending over a plurality of said wales into said warp yarn; and blind-lapping a second relatively thick warp yarn in said gap between said first yarns and said third yarns.

12. The method defined in claim 11 wherein said second and third weft yarns are oppositely lapped, each with formation of loops at said warp yarns.

13. The method defined in claim 6 wherein said weft and second yarns are so tensioned as to imbed themselves in said thick yarn.

14. The method defined in claim 6, further comprising the step of mounting a succession of coupling teeth astraddle of said edges after knitting of said tape.

15. The method defined in claim 6, further comprising the step of heat-shrinking said weft and thin warp yarns.

16. A slide-fastener stringer half comprising a knit tape formed with a multiplicity of warp chains including an edge warp chain along a coupling edge of the tape and spaced by the width of a warp chain from the next warp chain of the tape, a weft interconnecting said warp chains, and at least one stationary thread thicker than the yarns of said warp chains and said weft lying between said edge warp chain and said next warp chain, said weft including binding threads extending back and forth between said edge and next warp chains above and below said stationary thread and retaining same, said binding threads and stationary thread forming a bead along said coupling edge of the tape, and coupling members spaced along said coupling edge and straddling said bead, said binding threads having loops interknit with said edge and next warp chains.

17. The slide-fastener stringer half defined in claim 16 wherein said coupling members are composed of metal.

18. The slide-fastener stringer half defined in claim 16 wherein said coupling members are composed of synthetic resin molded onto said bead.

19. The slide-fastener stringer half defined in claim 16 wherein said binding threads are inlaid wefts having a 0-0/3-3 pattern.

20. The slide-fastener stringer half defined in claim 16 wherein at least one of said binding threads is of 2-3/1-0 pattern.

21. The slide-fastener stringer half defined in claim 16 wherein at least one of said binding threads is of 1-0/2-3 pattern.

22. The slide-fastener stringer half defined in claim 16 wherein said stationary thread has a 0-0 pattern.

23. The slide-fastener stringer half defined in claim 16 wherein two such stationary threads lie between said edge warp chain and said next warp chain and said binding threads pass over and under said stationary threads individually.

24. The slide-fastener stringer half defined in claim 16 wherein said binding threads and said stationary thread are composed of cotton and all of the other yarns of said weft and said warp chains are composed of polyester staple fiber.

* * * * *